US005893664A

United States Patent [19]

Kumasaka et al.

[11] Patent Number: 5,893,664

[45] Date of Patent: Apr. 13, 1999

[54] MULTI-COLOR IMAGE FORMING APPARATUS HAVING ARRANGEMENTS FOR REDUCING OZONE GENERATION

[75] Inventors: Takao Kumasaka, Takahagi; Nobuyoshi Hoshi, Hitachinaka, both of Japan

[73] Assignee: Hitcahi, Ltd., Tokyo, Japan, JPX

[21] Appl. No.: 08/914,882

[22] Filed: Aug. 20, 1997

[30] Foreign Application Priority Data

Aug. 23, 1996 [JP] Japan ..... 8-222460

[51] Int. Cl.[6] ..... G03G 15/16; G03G 21/00

[52] U.S. Cl. ..... 399/296; 399/98

[58] Field of Search ..... 399/296, 298, 399/318, 66, 232, 98

[56] References Cited

U.S. PATENT DOCUMENTS

| | | | |
|---|---|---|---|
| 4,078,929 | 3/1978 | Gundlach . | |
| 4,189,224 | 2/1980 | Sakai | 399/232 X |
| 4,264,185 | 4/1981 | Ohta | 399/232 |
| 4,937,629 | 6/1990 | Maruyama et al. | 399/232 |
| 4,937,630 | 6/1990 | Yoshikawa et al. | 399/232 |
| 5,406,313 | 4/1995 | Noami et al. | 399/232 X |
| 5,459,563 | 10/1995 | Fuma et al. | 399/296 X |

FOREIGN PATENT DOCUMENTS

| | | |
|---|---|---|
| 48-053729 | 7/1973 | Japan . |
| 48-057637 | 8/1973 | Japan . |
| 55-137538 | 10/1980 | Japan . |
| 57-023953 | 2/1982 | Japan . |
| 4-174878 | 6/1992 | Japan . |

*Primary Examiner*—S. Lee

*Attorney, Agent, or Firm*—Antonelli, Terry, Stout & Kraus, LLP

[57] ABSTRACT

A multi-color image forming apparatus is capable of decreasing the amount of ozone generation which occurs during the formation of a multi-color image. For this purpose, a charged latent image having a tri-level electric potential is formed on a positive charging photoconductor by a charging means and an exposing means. A first color toner having one of a positive polarity and a negative polarity is caused to adhere onto one of the charged latent images having the highest electric potential level at a first developing unit of the apparatus, and a second color toner having the other polarity is caused to adhere onto the other of charged latent images having the lowest electric potential at a second developing unit of the apparatus. After that, the polarity of the toner having the negative polarity is reversed using a positive corona produced by a pre-transfer charging means to unify both polarities of the two color toners, and then both toners having the unified polarity are s transferred onto a sheet of paper.

24 Claims, 3 Drawing Sheets

MULTI-COLOR IMAGE FORMING APPARATUS HAVING ARRANGEMENTS FOR REDUCING OZONE GENERATION

BACKGROUND OF THE INVENTION

The present invention relates to a multi-color image forming apparatus, which may be used in an electrophotographic apparatus, such as a copy machine, a printer, a facsimile machine and so on.

In a multi-color image forming apparatus, a charging unit, an exposing unit, a first developing unit, a second unit developing unit, a pre-transfer unit and a transfer unit are arranged around a drum on which a photoconductor is formed. In order to obtain a tri-level, two-color image, the photoconductor is initially charged by the charging unit, and then a charged latent image of the tri-level electric potential is formed on the photoconductor by the exposing unit, as shown in FIG. 6.

In FIG. 6, a portion $L_1$ is a first latent image portion at the highest electric potential level $V_0$ (representing the level to which the surface is charged by the charging unit) and a portion $L_2$ is a second latent image portion at the lowest electric potential $V_r$, and to these first and second portions a first color toner and a second color toner, to be described later, are caused to adhere, respectively. An intermediate electric potential $V_W$ is a background level. The second latent image portion $L_2$ is formed by a negative image exposure of strong intensity, and the latent image portion at the intermediate electric potential level $V_W$ is formed by a positive image exposure of weak intensity.

The first latent image portion is developed by the first developing unit, and the second latent image portion is developed by the second developing unit. That is, the first color toner having a polarity opposite to the charge polarity of the photoconductor is caused to adhere onto the first latent image portion $L_1$ by setting the developing bias voltage of the first developing unit to $V_{b1}$ (normal development), and the second color toner having the same polarity as the charge polarity of the photoconductor is caused to adhere onto the second latent image portion L2 by setting the developing bias voltage to the second developing unit to $V_{b2}$ (reversal development).

The first color toner and the second color toner, applied in the manner described above, are unified to either a positive or a negative polarity by the pre-transfer charger and are transferred onto a print medium by the transfer unit. The transferred toner is then heat-melted and fixed on the print medium.

The technology relating to such a two-color image forming process, as described above, is proposed in Japanese Patent Application Laid-Open No. 48-57637 and in U.S. Pat. No. 4,078,929, and the technology relating to the pre-transfer charging for charging the positive and the negative charged toner to either a positive or negative polarity is disclosed in Japanese Patent Application Laid-Open No. 48-53729.

In a multi-color image forming apparatus, an organic photoconductor (OPC), which can be negatively charged, is used for the photoconductor. However, the initial electric potential charge is likely to be higher in a tri-level method than in a bi-level method in which a charged latent image of two electric potential levels is formed. When the initial electric potential charge becomes high, the amount of ozone generation is likely to be increased. Further, in a single-color image forming mode, in which a charged latent image of bi-level electric potential is formed and a single-color image is obtained, it is necessary to perform pre-transfer charging depending on the polarity of the toner to be used, and, accordingly, the amount of ozone generation is likely to be increased even more than when pre-transfer charging is not performed.

SUMMARY OF THE INVENTION

An object of the present invention is to provide a multi-color image forming apparatus which is capable of decreasing the amount of ozone generation which occurs during multi-color image forming.

Another object of the present invention is to provide a multi-color image forming apparatus which is capable of decreasing the amount of ozone generation which occurs, when the image forming mode is switched from a multi-color image forming mode to a single-color image forming mode to obtain a single-color toner image.

A feature of the present invention is characterized by provision of a multi-color image forming apparatus comprising a positive charging photoconductor; a means for forming a charged latent image having first, second and third electrical potential levels which are different from one another on the photoconductor; a developing means for causing positive charged toner and negative charged toner to adhere onto one portion and another portion, respectively, of the photoconductor, the portions respectively having a charged latent image of the highest electric potential level and a charged latent image of the lowest electric potential level among first, second and third electric potential levels on the photoconductor; a pre-transfer charging means for generating a positive corona so as to reverse the polarity of the negative toner adhering to the photoconductor; and a means for transferring the positive toner and the polarity-reversed toner from the photoconductor onto a print medium.

According to this multi-color image forming apparatus, since a positive charging photoconductor is used to form the toner image, and a positive corona pre-transfer charger is used for reversing the polarity of the negative toner, it is possible to substantially reduce the amount of generated ozone producing during charging of the photoconductor before forming a charged latent image on the photoconductor and which is produced during the reversing of the polarity of toner before transferring the toner image to the print medium.

Another feature of the present invention is characterized by provision of a multi-color image forming apparatus comprising a positive charging photoconductor; a means for forming a charged latent image having first, second and third electrical potential levels which are different from one another on the photoconductor; a developing means for causing positively charged toner and negatively charged toner to adhere onto one portion and another portion, respectively, of the photoconductor, the portions respectively having a charged latent image of the highest electric potential level and a charged latent image of the lowest electric potential level among the first, second and third electric potential levels on the photoconductor; a pre-transfer charging means for unifying the polarity of the positively charged toner and negatively charged toner adhering to the photoconductor; and a means for transferring the polarity-unified toner onto a print medium; wherein one toner of the positively charged toner and the negatively charged toner is a color toner and the other toner is a black toner, the polarity-unifying means operating to reverse the polarity of the color toner.

According to this multi-color image forming apparatus, since a positive charging photoconductor is used for the photoconductor, it is possible to reduce the amount of generated ozone producing during charging of the photoconductor before forming a charged latent image on the photoconductor. Further, since the transferring means is formed so as to transfer a toner having the same polarity as the black toner, it is not necessary to reverse the polarity of the black toner prior to transferring the toner during forming of a single-color black image. This is particularly advantageous, since, in single-color printing, black generally has a higher frequency of use than other colors. Therefore, since there is no need to operate the polarity unifying means prior to the transferring of the toner during monochromatic black printing, it is possible to avoid the generation of ozone when performing most single-color printing.

Still another feature of the present invention is characterized by provision of a multi-color image forming apparatus comprising a photoconductor; a means for forming a charged latent image on the photoconductor; a developing means for causing toner to adhere onto portions of the photoconductor having the charged latent image formed thereon; and a means for transferring the toner onto a print medium; wherein the developing means comprises a first toner developing unit and a second toner developing unit. When a two-color image is to be obtained, said first toner developing unit and said second toner developing unit are operated so that toners having polarities opposite to each other, respectively, are caused to adhere onto corresponding portions of said charged latent image, the polarity of one of said first toner and said second toner being reversed prior to transferring of the toner by said transferring means. When a single-color image is to be obtained, one of the first toner developing unit and the second toner developing unit is operated, while the other is not operated, and the polarity at the time of toner transferring by the transferring means is switched corresponding to the polarity of the toner used in the toner developing unit to be operated.

According to this multi-color image forming apparatus, not only is it possible to use a multi-color image forming mode and single-color image forming mode by selective switching, but also a reversing of the polarity of the toner before transferring becomes unnecessary in use of the single-color image forming mode; and, soon after toner is caused to adhere onto the photoconductor by the toner developing unit, the attached toner can be transferred onto. a print medium, that is, pre-transfer charging is unnecessary. Therefore, the amount of generated ozone can be suppressed to a low level during single-color image forming, which is generally higher in frequency of use than multi-color image forming.

Other characteristics and advantages of the present invention will be clearly understood from the following description of various preferred embodiments when taken with reference to the accompanying drawings.

DETAILED DESCRIPTION OF THE PREFERRED EMBODIMENTS

Various embodiments of the present invention will be described in detail below with reference to the accompanying drawings.

Figure 1:
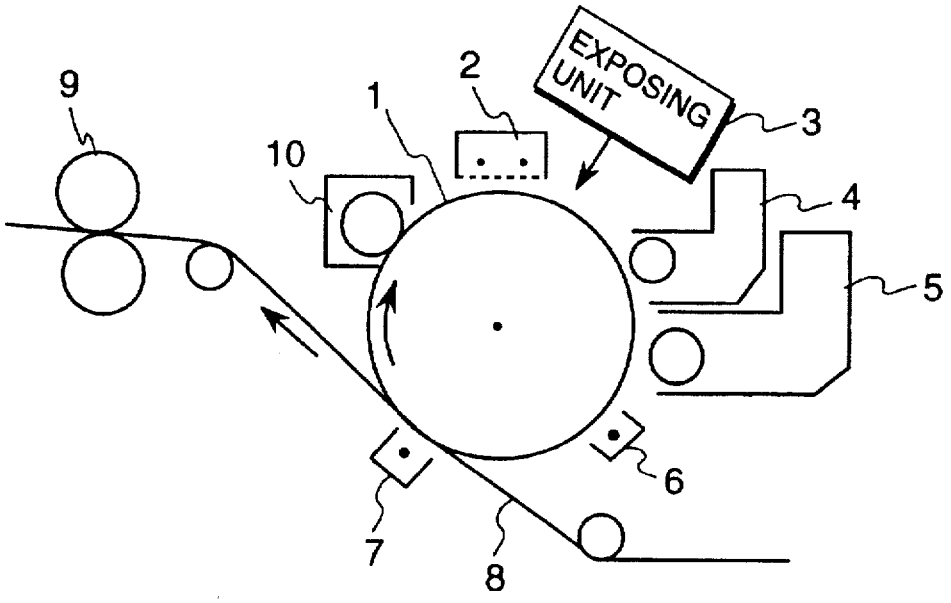
FIG. 1 is a schematic diagram showing an embodiment of a multi-color image forming apparatus in accordance with the present invention.
Figure 2:
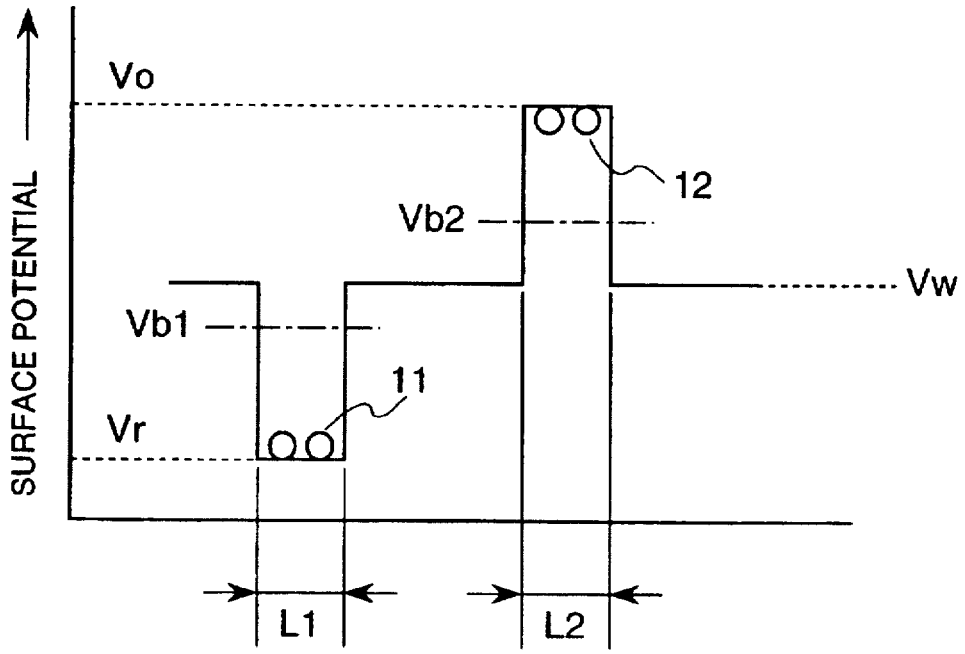
FIG. 2 is a diagram showing a charged latent image of tri-level electric potential formed on a photoconductor as used in the present invention.

Referring to FIG. 1, arranged around a drum on which a photoconductor 1 is formed are a charging unit 2, an exposing unit 3, a developing arrangement composed of a first developing unit 4 and a second developing unit 5, a pre-transfer charger 6 and a cleaner 10. The photoconductor 1 is charged by the charging unit 2. A charged latent image of tri-level electric potential is formed on the photoconductor drum 1 by the exposing unit 3, as shown in FIG. 2. Referring to FIG. 2, a portion $L_1$ is a first latent image portion at the lowest electric potential level $V_r$ and a portion $L_2$ is a second latent image portion at the highest electric potential level $V_0$ (this electric potential level is the level to which the surface of the photoconductor is charged by the charging unit 2), and a first color toner and a second color toner, to be described later, are caused to adhere to these portions, respectively. An intermediate electric potential level $V_W$ represents a background level. The first latent image portion $L_1$ is formed by a negative image exposure of strong intensity, and the latent image portion at the intermediate electric potential level $V_W$ is formed by a positive image exposure of weak intensity.

The first latent image portion $L_1$ is developed by the first developing unit 4, and the second latent image portion $L_2$ is developed by the second developing unit 5. That is, a first color toner having the same polarity as the polarity of the charge on the photoconductor 1 is caused to adhere onto the first latent image portion $L_1$ by setting a developing bias voltage of the first developing unit 4 to $V_{b1}$ (reversal development), and a second color toner having a polarity opposite to the polarity of the charge on the photoconductor 1 is caused to adhere onto the second latent image portion $L_2$ by setting a developing bias voltage of the second developing unit to $V_{b2}$ (normal development).

The first color toner and the second color toner developed in the manner described above are unified to either a positive or a negative polarity by the pre-transfer charger 6, and the toner image is then transferred onto a print medium 8 by a transfer unit 7. The transferred toner is heat-melted and fixed onto the print medium 8 by a fixing unit 9. After the transferring of the toner image to the print medium, the photoconductor 1 is cleaned by the cleaner 10 to remove any remaining first color toner and remaining second color toner from the photoconductor.

(1) First Embodiment

Referring to FIG. 1 and FIG. 2, a positive charging photoconductor drum was used as the photoconductor drum 1. A color toner was used for the first color toner and a black toner was used for the second color toner. The voltage $V_0$ was set to 850–950V, the voltage $V_r$ was set to 50–100V and the voltage $V_W$ was set to 500–600V. Further, the pre-transfer charging unit 6 irradiated a positive corona, or alternating current corona having a positive corona component which is greater than its negative corona component, to a two-color toner image positively and negatively charged so that the polarities of both of the positively and negatively charged toners were made positive. A negative corona charging unit was used for the transfer unit 7.

An amorphous silicon positive photoconductor, a selenium-group photoconductor, a positive charging organic photoconductor or the like may be used as the positive charging photoconductor 1. However, it is preferable to use the selenium-group photoconductor or the positive charging organic photoconductor, which can be charged up to a high voltage.

As the positive charging organic photoconductor, a single-layer type organic photoconductor, for example, an organic photoconductor of the Mita-Kogyo Co. (Trademark: MARINE OPC drum), is preferable, but an organic photoconductor of the two-layer type (composed of a charge generating layer CGL and a charge transferring layer CTL) may be employed as well. Further, it is possible to employ a construction in which a blocking layer is provided between an aluminum layer and a photoconductor layer.

The pre-transfer charging unit 6 is a positive corona charger, or an alternating current corona charger in which a positive direct current component and an alternating current component are superposed, so as to reverse the polarity of the negative toner. For example, in a case where an alternating current corona charger is used, the direct current component (DC) is set to a voltage of 2 to 5 kV, the alternating current component (AC) is set to a peak-to-peak voltage of 3 to 7 kV and the frequency is set to 500 to 1000 Hz. Although a corona charger is used for the transfer unit 7 in this example, it is also possible to employ a belt transfer unit, a transfer unit using a transfer roller or the like.

As a developing agent for the first developing unit 4, it is preferable to use a low resistance developing agent in order to maintain the image density and to suppress fringe. Further, when the first color development is performed by bringing the photoconductor body in contact the low resistance developing agent, a charge on the surface of the photoconductor body is leaked to the low resistance developing agent as the first color development progresses. By doing so, it is possible to advantageously reduce the carrier sticking when the second color development is performed by the second color developing unit 5. The low resistance developing agent which is used has a carrier resistance of $10^6$–$10^9$ Ωcm, and the current value is 1–100 μA when a voltage of 50–600V, corresponding to the developing voltage, is applied thereto.

The carrier for the first color was a ferrite or magnetite carrier which had an average grain size of 60 to 120 μm, an apparent bulk density of 2.2 to 2.8 g/cm$^3$ and a saturation magnetizing force of 60 to 100 emu/g. The surface of the carrier was coated with a silicon group resin or an acrylic group resin in order to improve the charging property and stability, and the resistance was adjusted by adding carbon into the coating resin.

The first color toner was a color toner which had an average grain size of 6 to 11 μm and a charge capacity of 7 to 11 μc/g at a mixing ratio with the carrier of 3 to 6 wt %. The gap between the first color developing roll and the photoconductor body was set to 0.7 to 1.6 mm, and the gap between the first color developing roll and a restricting plate was set to a value smaller than the gap between the first color photoconductor body by 0.1 to 0.3 mm. The charge on the surface of the photoconductor may be made to leak to ground as the first color development progresses by setting the resistance between the surface of the developing roll of the first developing unit 4 and the ground to 50 to 5000 MΩ.

The second color carrier was a carrier having the same composition as that of the first color carrier. The second color toner was a black toner which had an average grain size of 7 to 12 μm and a charge capacity of −7 to −11 μc/g at a mixing ratio with the carrier of 3 to 6 wt %. As for the first color toner and the second color toner, silica and conductive particles, such as titanium oxide particles, were added onto the toner surface to adjust the resistance, the fluidity and the charging property. Further, fog in the background area formed during two-color image forming could be reduced by setting the mutual relationship between the first and second color developing agents so that the charge capacity of the first color toner became smaller than a friction charge with the second color carrier by 4 μc/g.

Although in the above embodiment a positively charged color toner is used for the first color and a negatively charged black toner is used for the second color, it is possible for a positively charged black toner to be used for the first color and a negatively charged color toner to be used for the second color.

Since a positive charging organic photoconductor body is used as the photoconductor 1 in the above embodiment, the amount of ozone generated by the main charging of the photoconductor in a two-color process can be reduced. Further, since pre-transfer corona charging is performed by applying an alternating current shifted toward the positive voltage, the amount of ozone generated by pre-transfer charging can be reduced. Therefore, in a two-color process using a tri-level method, there is an effect that the amount of ozone generated by the main charging of the photoconductor and by pre-transfer charging can be substantially reduced.

(2) Second Embodiment

Figure 3:
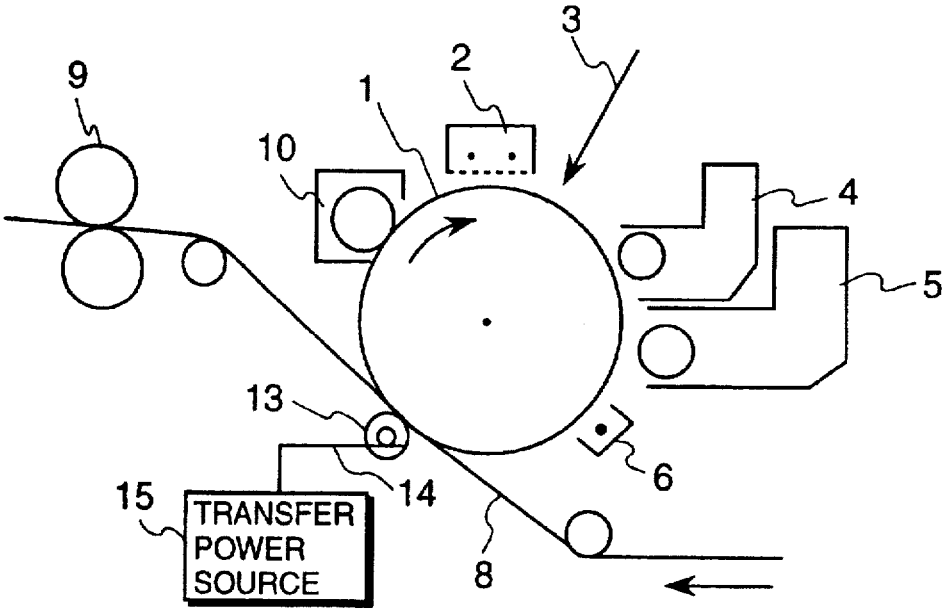
FIG. 3 is a schematic diagram showing another embodiment of a multi-color image forming apparatus in accordance with the present invention.

Referring to FIG. 3, a different feature of the second embodiment as compared to the first embodiment is that a roller transfer unit is used for the transfer unit. The roller transfer unit comprises a transfer roller 13 composed of a conductive rubber roller, a transfer power source 15 and a power supply connecting member 14. Since this embodiment has the same construction as that of the first embodiment, except for the transfer unit, a two-color toner image formed on the photoconductor body 1 is unified in polarity by the pre-transfer charger to the positive polarity. Therefore, a negative transfer bias voltage of −500 to −1000 V is applied to the transfer roller 13 to transfer a two-color toner image onto a sheet of paper.

In this embodiment, since transferring of the toner image is performed using a transfer roller in a transferring process, there is an effect that the amount of ozone generated in the transferring process can be substantially reduced compared to the first embodiment wherein a corona charging transfer unit is used.

(3) Third Embodiment

A third embodiment of the invention will be described below, with reference to FIG. 1 and FIG. 2. The main difference between the third embodiment and the first embodiment are that, in the third embodiment, a negative corona or alternating current corona having a negative corona component greater than positive corona component is irradiated using the pre-transfer charging unit 6, so as to unify the polarities of the two color toners to the negative polarity, which is the charge polarity of the black toner, and a positive corona charging unit is used as the transfer unit 7. For the transfer unit, either a belt transfer type unit or a roller transfer type unit may be used.

In this embodiment, since a negative corona, or an alternating current corona having a negative corona component greater than its positive corona component, is irradiated using the pre-transfer charging unit 6, the amount of ozone generated during the pre-transfer charging is increased compared to the first embodiment. However, since positive corona charging is performed in the toner image transferring process, there is an effect that the amount of ozone generated in the toner image transferring process can be reduced compared to the first embodiment wherein negative corona charging is employed.

Further, in this embodiment, since the polarity of the transfer unit 7 is set to be opposite to the charge polarity of the black toner, there is no need to operate the pre-transfer charging unit 6 when a black single-color image is formed. As a result, there is an effect that the amount of ozone which is generated can be suppressed to a low level when forming a black single-color image, which has a higher frequency of use as compared to a case of two-color image forming or a single color image forming other than black.

(4) Fourth Embodiment

Figure 4:
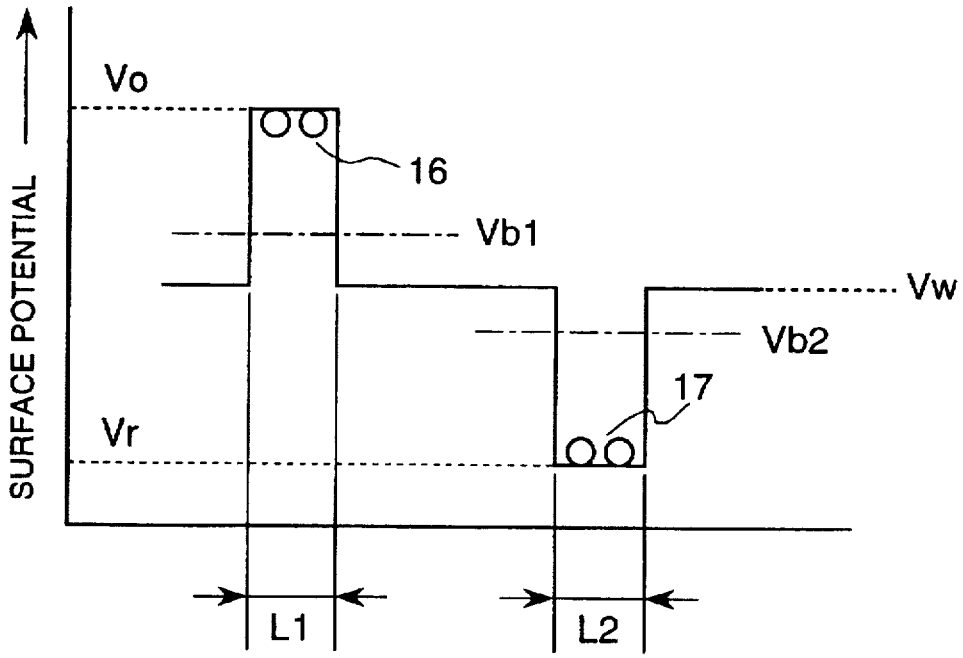
FIG. 4 is a diagram showing another charged latent image of tri-level electric potential formed on a photoconductor as used in the present invention.
Figure 6:
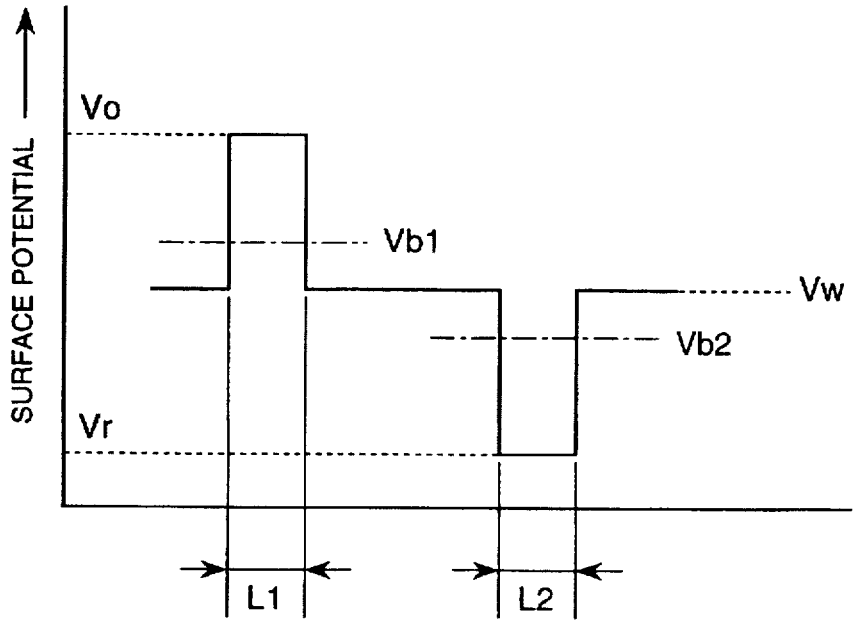
FIG. 6 is a diagram showing an example of a general charged latent image of tri-level electric potential formed on a photoconductor.

A fourth embodiment of the present invention will be described below, with reference to FIG. 3 and FIG. 4. Since the method of charged latent image forming (FIG. 4) is the same in this embodiment as that of FIG. 6, an explanation thereof will be omitted here in order to avoid redundancy The main difference between the fourth embodiment and the second and the third embodiments is as follows. Letting a latent image portion having the highest electric potential $V_0$ be a first latent image portion $L_1$, a latent image portion having the lowest electric potential $V_r$ be a second latent image portion $L_2$, the first color toner 16 be a negatively charged color toner, and the second color toner 17 be a positively charged black toner, a negatively charged color toner image and a positively charged black toner image are respectively formed in the first latent image portion $L_1$ and the second latent image portion $L_2$ on the photoconductor body 1 by the first and second developing units 4, 5. Using the pre-transfer unit 6, a positive corona, or an alternating current corona having a positive corona component greater than its negative component, is irradiated on the toner image so as to reverse the charge polarity of the color toner to unify the polarities of the two color toners to the positive polarity, which is the charge polarity of the black toner. Further, a transfer unit of the roller type for applying a negative bias voltage is used as the transfer unit 7.

In this embodiment, since the pre-transfer unit 6 irradiates a positive corona, or an alternating current corona having a positive corona component greater than its negative corona component, the amount of ozone generated in the pre-transfer charging can be reduced to the same extent as in the first embodiment. Since a transfer roller is used for transferring the toner image in the transferring process, the amount of ozone generated in the transfer process can be substantially reduced to the same extent as in the second embodiment. Further, since the polarity of the transfer unit 7 is set to be opposite to the charge polarity of the black toner, there is no need to operate the pre-transfer unit 6 during black single image forming. As a result, there is an effect that the generated amount of ozone can be suppressed to a low level during forming of a black single-color image, which has a higher frequency of use as compared to the case of two-color image forming or single color image forming other than black.

Although the foregoing description has been directed mainly to the case where the first color is provided by a color toner and the second color is provided by a black toner, the present invention can be applied to a case where the first color is provided by a black toner and the second color is provided by a color toner. However, in order to moderate the muddiness of the color in a second color image, it is preferable for the first color to be provided by a color toner and the second color to be provided by a black toner, for reasons to be described below.

More particularly, in a case of forming a two-color image, in the process of carrying out the second developing operation using the second developing unit 5, the first color toner on the photoconductor 1 contacts the developing agent (magnetic brush) of the second developing unit 5, and the first color toner is scraped off by a small amount and is apt to be mixed into the developing agent of the second developing unit 5. As a result, the amount of the first color toner mixed into the second color image toner is gradually increased to produce an unintentional color mixing (muddiness of color). Therefore, when the first color is provided by a color toner and the second color is provided by a black toner, the color mixing phenomenon is unnoticeable, and so such a combination is preferable in order to moderate the muddiness of the color.

(5) Fifth Embodiment

Figure 5:
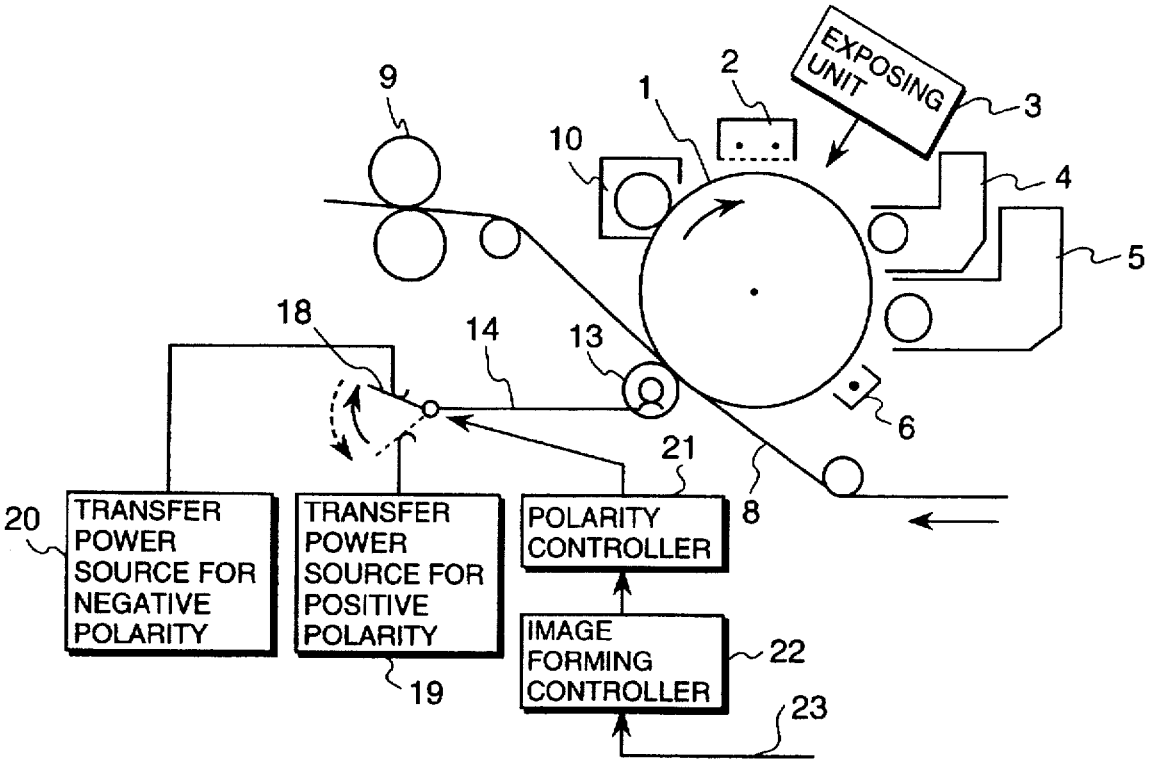
FIG. 5 is a schematic diagram showing a further embodiment of a multi-color image forming apparatus in accordance with the present invention.

In addition to the second embodiment shown in FIG. 3, the embodiment of FIG. 5 comprises a transfer power source for positive polarity 19, a transfer power source for negative polarity 20, a polarity switching unit 18, a polarity controller 21 and an image forming controller 22, and the polarity of the transfer power supplied to the transfer roller 13 is switched based on a color selection signal 23, so that the polarity of the transfer power is set to a polarity opposite to the polarity of the toner to be developed, depending on the toner to be developed during forming of a single-color image.

Although a transfer unit of the roller transfer type having a transfer roller 13 has been shown in connection with the above embodiment, a corona charging type unit or a belt transfer type unit may be employed as well. However, in that case, it is preferable to employ the roller transfer type unit in order to reduce the amount of ozone generated during the transfer process. Further, although the basic principle of this embodiment can be applied to a case where the photoconductor 1 is a negative charging photoconductor, it is preferable for the photoconductor to be a positive charging photoconductor in order to reduce the amount of ozone produced during the main charging of the photoconductor.

In the case of this embodiment, since the polarity of the transfer power source is switched depending on the toner used for formation of a single-color image, the pre-transfer charging unit 6 can be set so as to be not operated during formation of single-color image, which adds to the effect to reduce the amount of ozone produced by operation of the pre-transfer charging unit 6. Further, even in forming a two-color image, since a positive charging photoconductor is used for the photoconductor and the pre-transfer charging involves use of a positive corona for reversing the polarity of the negative charged toner, there is an effect to reduce the amount of ozone produced by the main charger and the transferring unit.

In the case of forming a single-color image, it is not always necessary to form a charged latent image of bi-level electric potential, but it is possible to obtain a single-color image by forming a charged latent image of tri-level electric potential and by causing the single-color toner to adhere onto a charged latent image at one the electric potential levels.

According to the present invention, it is possible to provide a multi-color image forming apparatus which is capable of decreasing the amount of ozone generation occurring in multi-color image forming.

According to the present invention, it is possible to provide a multi-color image forming apparatus which is capable of decreasing the amount of ozone generation, when the image forming mode is switched from a multi-color image forming mode to single-color image forming mode, to obtain a single-color toner image.

What is claimed is:

1. A multi-color image forming apparatus comprising:

a photoconductor adapted to be positively charged;

means for forming a charged latent image having first, second and third electrical potential levels, which are different from one another, on said photoconductor;

developing means for causing positively charged toner and negatively charged toner to adhere onto one portion and another portion, respectively, of said charged latent image on said photoconductor, said portions respectively representing a charged latent image portion of a highest electric potential level and a charged latent image portion of a lowest electric potential level among said first, second and third electrical potential levels on said photoconductor;

pre-transfer means for generating a positive corona so as to reverse a polarity of said negatively charged toner on said photoconductor; and transferring means for transferring said positively charged toner and polarity-reversed toner from said photoconductor onto a print medium.

2. A multi-color image forming apparatus according to claim 1, wherein said transferring means is of a transferring roller type.

3. A multi-color image forming apparatus according to any one of claim 1 or claim 2, wherein either one of said positively charged toner and said negatively charged toner is a color toner and the other of said positively charged toner and said negatively charged toner is a black toner; and said toner developing means comprises a first toner developing unit for causing said color toner to adhere to said photoconductor and a second toner developing unit for causing said black toner to adhere to said photoconductor.

4. A multi-color image forming apparatus comprising:

a photoconductor adapted to be positively charged;

means for forming a charged latent image having first, second and third electrical potential levels, which are different from one another on said photoconductor;

toner developing means for causing positively charged toner and negatively charged toner to adhere onto one portion and another portion, respectively, of said charged latent image on said photoconductor, said portions respectively representing a charged latent image portion of a highest electric potential level and a charged latent image portion of a lowest electric potential level among said first, second and third electrical potential levels on said photoconductor;

pre-transfer means for unifying a polarity of said positively charged toner and said negatively charged toner on said photoconductor; and transfer means for transferring polarity-unified toner from said pre-transfer means onto a print medium; wherein either one of said positively charged toner and said negatively charged toner is a color toner and the other of said positively charged toner and said negatively charged toner is black toner; and wherein said pre-transfer means operates to reverse the polarity of said color toner.

5. A multi-color image forming apparatus according to claim 4, wherein said toner developing means comprises a first toner developing unit for causing said color toner to adhere to the photoconductor and a second toner developing unit for causing said black toner to adhere to said photoconductor.

6. A multi-color image forming apparatus comprising:

a photoconductor;

means for forming a charged latent image on said photoconductor;

developing means for causing toner to adhere onto portions of said photoconductor having said charged latent image formed thereon; and means for transferring said toner from said photoconductor onto a print medium; wherein said developing means comprises a first toner developing unit and a second toner developing unit, which operate such that: (1) when a two-color image is to be obtained, said first toner developing unit and said second toner developing unit are operated so that first and second toners having polarities opposite to each other are caused to adhere, respectively, onto corresponding portions of said charged latent image, the polarity of one of said first toner and said second toner is reversed prior to the transferring of said first and second toners by said transferring means; and (2) when a single-color image is to be obtained, one of said first toner developing unit and said second toner developing unit is operated, while the other is not operated, and the polarity of the toner to be transferred by said transferring means is switched corresponding to the polarity of the toner used in the toner developing unit which is operated.

7. A multi-color image forming apparatus according to claim 6, wherein said photoconductor is adapted to be positively charged.

8. A multi-color image forming apparatus according to any one of claim 6 or claim 7, which further comprises pre-transfer means for generating a positive corona for reversing the polarity of a negative toner among said first toner and said second toner prior to the transferring of said first and second toners by said transferring means.

9. A multi-color image forming apparatus according to any one of claim 6 or claim 7, wherein said transferring means comprises a transfer roller, said transferring of toner being performed using said transfer roller.

10. A multi-color image forming apparatus according to any one of claim 1, 4 or 7, wherein said photoconductor comprises an organic photoconductor adapted to be positively charged.

11. A multi-color image forming apparatus according to claim 3, wherein said first toner developing unit is adapted to cause said color toner to adhere to said photoconductor before said second toner developing unit causes said black toner to adhere.

12. A multi-color image forming apparatus according to claim 5, wherein said first toner developing unit is adapted to cause said color toner to adhere to said photoconductor before said second toner developing unit causes said black toner to adhere.

13. A multi-color image forming apparatus comprising:

a photoconductor adapted to be positively charged;

a latent image unit adapted to form a charged latent image having first, second and third electrical potential levels, which are different from one another, on said photoconductor;

a toner developer unit adapted to cause positively charged toner and negatively charged toner to adhere onto one portion and another portion, respectively, of said charged latent image on said photoconductor, said portions respectively representing a charged latent image portion of a highest electric potential level and a charged latent image portion of a lowest electric potential level among said first, second and third electrical potential levels on said photoconductor;

a pre-transfer unit adapted to generate a positive corona so as to reverse a polarity of said negatively charged toner on said photoconductor; and a transfer unit adapted to transfer said positively charged toner and polarity-reversed toner from said photoconductor onto a print medium.

14. A multi-color image forming apparatus according to claim 13, wherein said transfer unit is of a transfer roller type.

15. A multi-color image forming apparatus according to any one of claim 13 or claim 14, wherein either one of said positively charged toner and said negatively charged toner is a color toner and the other of said positively charged toner and said negatively charged toner is a black toner; and said toner developer unit comprises a first toner developing unit adapted to cause said color toner to adhere to said photoconductor and a second toner developing unit adapted to cause said black toner to adhere to said photoconductor.

16. A multi-color image forming apparatus comprising:

a photoconductor adapted to be positively charged;

a latent image unit adapted to form a charged latent image having first, second and third electrical potential levels, which are different from one another, on said photoconductor;

a toner developer unit adapted to cause positively charged toner and negatively charged toner to adhere onto one portion and another portion, respectively, of said charged latent image on said photoconductor, said portions respectively representing a charged latent image portion of a highest electric potential level and a charged latent image portion of a lowest electric potential level among said first, second and third electrical potential levels on said photoconductor;

a pre-transfer unit adapted to unify a polarity of said positively charged toner and said negatively charged toner on said photoconductor; and a transfer unit adapted to transfer polarity-unified toner from said pre-transfer unit onto a print medium; wherein either one of said positively charged toner and said negatively charged toner is a color toner and the other of said positively charged toner and said negatively charged toner is black toner; and wherein said pre-transfer unit operates to reverse the polarity of said color toner.

17. A multi-color image forming apparatus according to claim 15, wherein said toner developer unit comprises a first toner developing unit adapted to cause said color toner to adhere to the photoconductor, and a second toner developing unit adapted to cause said black toner to adhere to said photoconductor.

18. A multi-color image forming apparatus comprising:

a photoconductor;

a latent image unit adapted to form a charged latent image on said photoconductor;

a toner developer unit adapted to cause toner to adhere onto portions of said photoconductor having said charged latent image formed thereon; and a transfer unit adapted to transfer said toner from said photoconductor onto a print medium; wherein said toner developer unit comprises a first toner developing unit and a second toner developing unit, which operate such that: (1) when a two-color image is to be obtained, said first toner developing unit and said second toner developing unit are operated so that first and second toners having polarities opposite to each other are caused to adhere, respectively, onto corresponding portions of said charged latent image, the polarity of one of said first toner and said second toner is reversed prior to the transferring of said first and second toners by said transfer unit; and (2) when a single-color image is to be obtained, one of said first toner developing unit and said second toner developing unit is operated, while the other is not operated, and the polarity of the toner to be transferred by said transfer unit is switched corresponding to the polarity of the toner used in the toner developing unit which is operated.

19. A multi-color image forming apparatus according to claim 18, wherein said photoconductor is adapted to be positively charged.

20. A multi-color image forming apparatus according to any one of claim 18 or claim 19, which further comprises a pre-transfer unit adapted to generate a positive corona for reversing the polarity of a negative toner among said first toner and said second toner prior to the transferring of said first and second toners by said transfer unit.

21. A multi-color image forming apparatus according to any one of claim 18 or claim 19, wherein said transfer unit comprises a transfer roller, said transferring of toner being performed using said transfer roller.

22. A multi-color image forming apparatus according to any one of claim 13, 16 or 19, wherein said photoconductor comprises an organic photoconductor adapted to be positively charged.

23. A multi-color image forming apparatus according to claim 15, wherein said first toner developing unit is adapted to cause said color toner to adhere to said photoconductor before said second toner developing unit causes said black toner to adhere.

24. A multi-color image forming apparatus according to claim 17, wherein said first toner developing unit is adapted to cause said color toner to adhere to said photoconductor before said second toner developing unit causes said black toner to adhere.

* * * * *